United States Patent [19]

Robinson

[11] 4,138,108

[45] Feb. 6, 1979

[54] ATHLETIC HAND/WRIST POSITIONER

[76] Inventor: Charles H. Robinson, 1016 Thompson Ave., Glendale, Calif. 91201

[21] Appl. No.: 605,001

[22] Filed: Aug. 15, 1975

Related U.S. Application Data

[63] Continuation of Ser. No. 492,391, Jul. 29, 1974, abandoned.

[51] Int. Cl.[2] ..... A63B 69/00

[52] U.S. Cl. ..... 273/54 B; 273/189 A

[58] Field of Search ..... 273/54 B, 189 A; 128/77, 87 R, 89 R, 165; 2/161 A

[56] References Cited

U.S. PATENT DOCUMENTS

| | | | |
|---|---|---|---|
| 1,469,315 | 10/1923 | Hansard | 273/189 A |
| 3,327,703 | 6/1967 | Gamm | 128/77 |
| 3,436,075 | 4/1969 | Robinson | 273/54 B |
| 3,512,776 | 5/1970 | Thomas, Sr. | 273/54 B |
| 3,533,407 | 10/1970 | Smith | 128/165 |
| 3,728,738 | 4/1973 | Andolino | 273/54 B X |
| 3,779,550 | 12/1973 | Benoun et al. | 128/89 R X |
| 3,815,908 | 6/1974 | Hashimoto | 273/54 B |

*Primary Examiner*—Anton O. Oechsle

[57] ABSTRACT

A hand/wrist positioner or brace adapted for use by persons participating in sports, particularly bowling. It is made of flexible material to wrap around the hand and wrist in the manner of a wristband or more specifically a fingerless glove with securing means to hold it in position. It has a thumb hole to receive the thumb and ball of the thumb, its forward end extending to cover the palm and back of the hand. Provided in the front of the article, that is, on the palm side, there is a stiffening member to bridge between the palm and inner side of the wrist contoured to conform and extending into the palm of the hand. This stiffening member prevents forward flexing of the wrist. A second rigid stiffening member is provided in the back of the article to bridge between the back of the hand and wrist, this member having an outwardly bowed contour at the back of the wrist to restrain backward flexing of the wrist beyond the contoured position.

1 Claim, 5 Drawing Figures

ATHLETIC HAND/WRIST POSITIONER

This is a continuation of application Ser. No. 492,391, filed July 29, 1974, now abandoned.

BACKGROUND OF THE INVENTION

1. Field of the Invention

The field of the invention is that of wrist positioners embodying rigid brace members enclosed in flexible materials, adapted for use by persons participating in sports, more particularly to such an article in the form of a hand/wrist positioner adapted for use by bowlers.

2. Description of the Prior Art

The herein inventor is patentee in U.S. Pat. No. 3,436,075 which is directed to a bowling ball grip position indicator. That patent embodies a device which is wrapped around the wrist, but it and the prior art cited against it are not closely pertinent to the herein invention. The herein invention is considered to be unique, particularly in its bracing or stiffening capabilities. Reference is made to prior art U.S. Pats. Nos. 2,994,533; 2,369,201; 2,794,638; 3,117,786; 3,199,873; 3,105,972; and 3,238,939. Such prior art devices as have been commercialized do not permit positioning of the hand so that the center of the ball is aligned with the axis of the arm.

SUMMARY OF THE INVENTION

In the preferred exemplary form of the invention as described in detail herein, it takes the form of a snug-fitting fingerless glove or wristlet formed of flexible material which is wrapped around the wrist and hand and is then secured in position. The article extends forwardly of the thumb and has a thumb hole to receive the thumb and the ball or heel of the thumb. Brace or stiffening means or members are provided in pockets at the front and back of the article to serve the purpose of inhibiting forward or backward flexing of the wrist, particularly as to be prevented during the delivery of a bowling ball.

The primary object of the invention is to make available an article adapted to fill a need of persons participating in sports, particularly bowling, having the capability of providing bracing means to restrain forward and rearward flexing of the wrist during the act of delivering a ball, when bowling or otherwise.

A basic object is to make possible a more accurate, precise delivery of the ball, more particularly of a bowling ball with greater rotational speed to the end that the bowler bowls more accurately and makes a better score.

A further object is to realize the further capability as referred to in the foregoing in that in delivering the bowling ball, the user's wrist will not be positioned so that the hand and wrist are out of line with the center of the ball, but on the other hand, so that the arm is aligned with the center of the ball.

A further object is to realize the capability in the article that the user's wrist will not be flexed forwardly during delivery of a ball.

A further object is to realize the capability in the article that the user's wrist will not be flexed backwardly during delivery of the ball, beyond the desired position.

A further object is to realize the result of achieving greater control and ease of extraction of the user's thumb from the thumb hole in the bowling ball at the time of release.

BRIEF DESCRIPTION OF THE DRAWINGS

Further objects and additional advantages of the invention will become apparent from the following detailed description and annexed drawings, wherein.

DESCRIPTION OF THE PREFERRED EMBODIMENT

The article of the invention is called on automatic hand/wrist positioner. In position, it might be described as a snug-fitting fingerless glove having a thumb hole. Broadly speaking, it is an article which wraps around the arm, wrist, palm and back of the hand and having a thumb hole to receive the thumb and heel of the thumb. The article is long enough to extend the length of several inches above the wrist joint at the upper end and extending to an intermediate position, relative to the palm of the hand, at the lower end.

Figure 1:
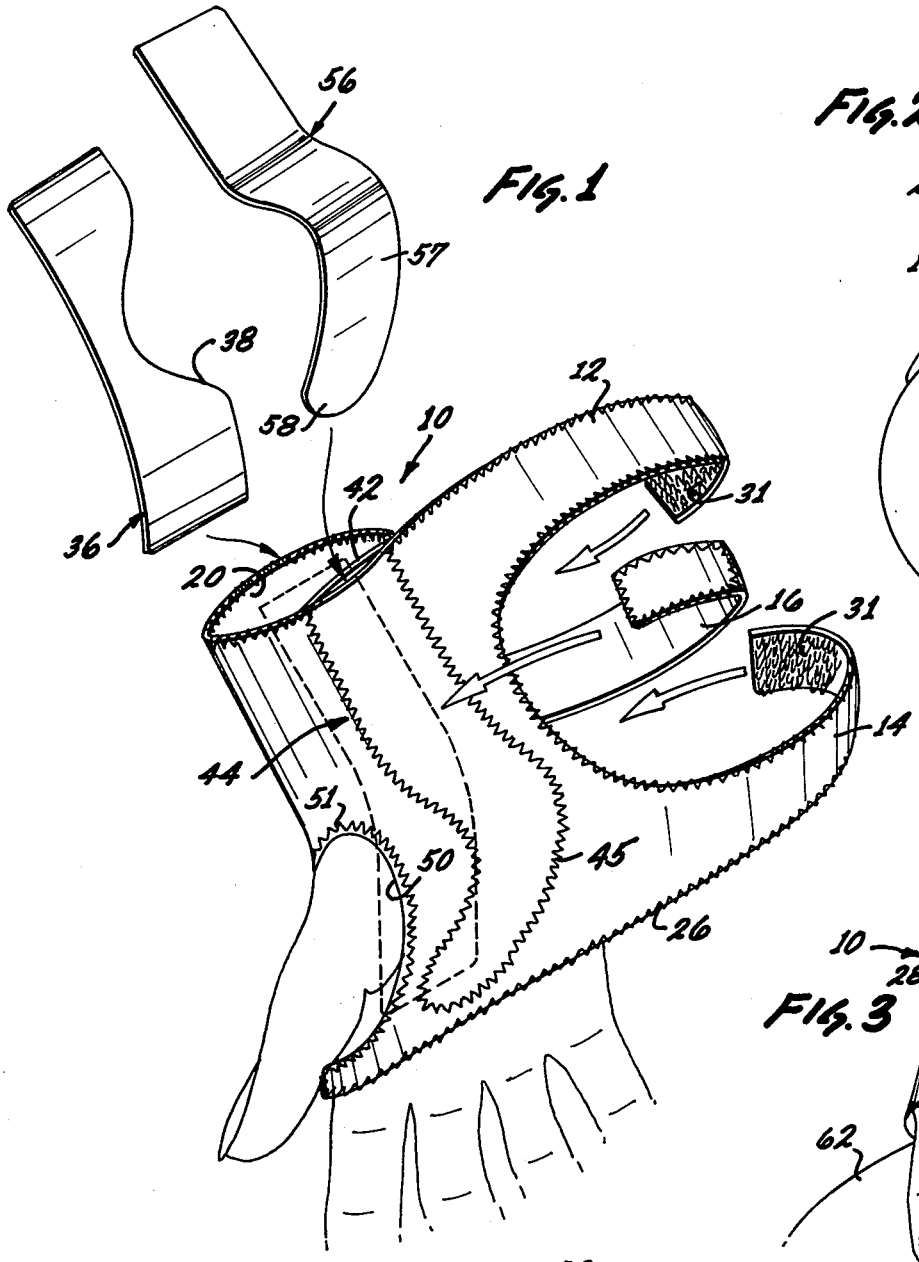
FIG. 1 is a pictorial view of the article showing it being applied by wrapping around the user's right hand and wrist.
Figure 2:
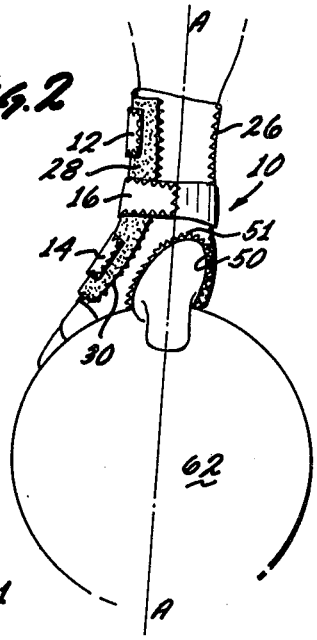
FIG. 2 is an illustrative view showing the left side of a user's hand with the article in position showing relationship to the hand, wrist and bowling ball.
Figure 3:
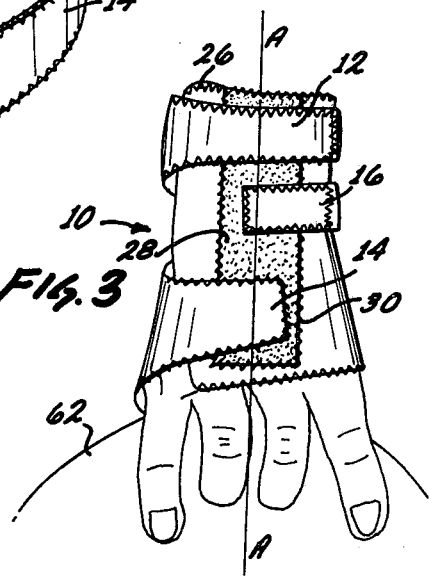
FIG. 3 is an illustrative view similar to FIG. 2 with the article in position, showing the back of the user's hand, the back of the article and its relationship to the wrist, hand and bowling ball.
Figure 5:
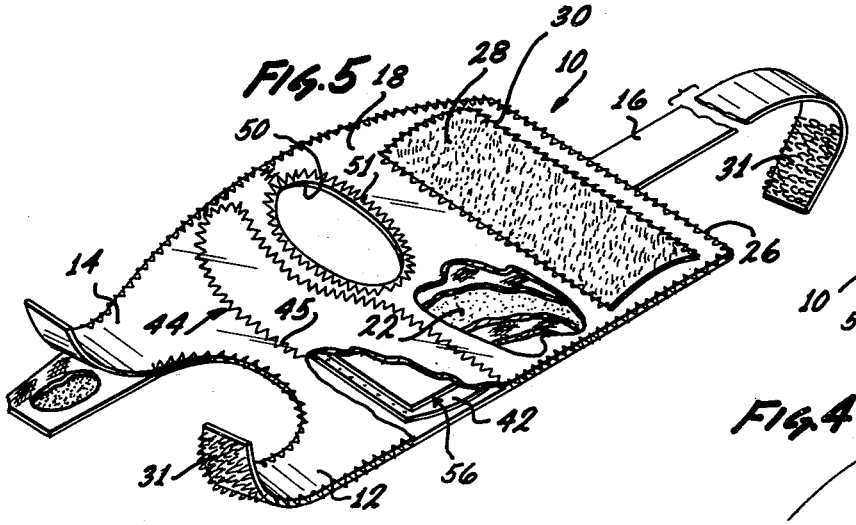
FIG. 5 is a view of the article of the invention in substantially flat condition.
Figure 4:
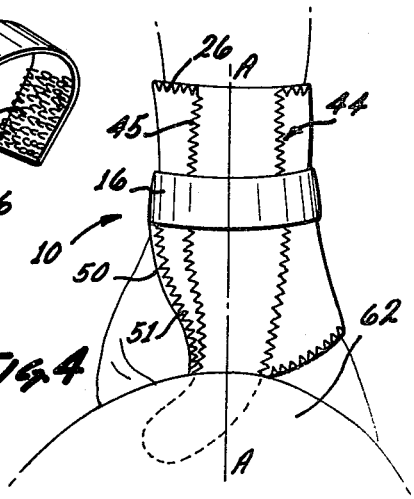
FIG. 4 is an illustrative view opposite to FIG. 3 and showing the article in position, the view being from the inside or palm side of the user's hand.

FIG. 1 shows the article in a position of being applied to the user's right hand. FIGS. 2, 3 and 4 are views of the article in position on the user's hand and showing its relationship to the hand and a bowling ball. In the exemplary form of the invention shown, the article has a shape as indicated at 10 in FIG. 5. It has two extending end parts 12 and 14 and at the other end, an intermediate fastening strap 16. The positioner or article is long enough to wrap around the wrist and to be fastened as shown in FIGS. 2, 3 and 4 and as will be described. As to extent along the wrist, it covers the wrist as shown in FIGS. 2, 3 and 4, and then extends to an intermediate position relative to the palm of the hand.

Preferably, the article is made from an outer layer of smooth material such as naugahide 18 having an inner lining of smooth fabric which may be silk, nylon, rayon or other material as designated at 20. Between the outer layer and lining, preferably, there is a layer of relatively thin fabric material 22 of a type to provide a limited degree of padding so that the article is soft, resilient, and comfortable to wear. The outer covering or layer, the lining, and the interior padding preferably may all be secured together around the edges by stitching designated at 26.

Adjacent to the right end of the band as seen in FIG. 1, there is secured to the outside a strip of fabric material which may be one element of a product known commercially as VELCRO or fabric with the VELCRO bonded to it designated at 28. The trademark VELCRO refers to an article for purposes of fastening comprising a pair of surfaces, one of which is loosely felted providing elements adapted to fasten to another element having closely spaced hook elements having rounded ends, the two surfaces or material being adapted to securely hold together when pressed against each other, but having the capability that they can be pulled apart so they can unfasten. The surfaces or elements may be called felted or hooked surfaces. Strip 28 is generally rectangular as shown, and it may be secured to the band by stitching shown at 30. It forms a pocket to receive a metal stiffener member 36. This member is bowed, the bow when in position will contour outward from the back of the hand and wrist and the bowed part having a curved recess 38 for a purpose as will be described.

The inner surfaces of the extensions 12 and 14 and strap 16 carry one of the VELCRO fastening elements which preferably are the hooked surfaces 31.

Panel 42 is attached to the palmside covering of the article and is shaped to form a pocket 44 for a stiffening insert. It has a shape which may be seen in FIG. 1, and it is secured to the article by stitching 45.

In the article as described, it has a hole or opening 50 of oval shape having stitching 51 around its edges. Hole 50 is of a shape to receive the thumb of the hand, including the ball or heel of the thumb as may be observed more clearly in FIG. 2. Rigid insert 36 fits into the pocket formed by member 28 as described. Insert 36 has a recess or cutout 38, and it is bowed or contoured slightly so as to be (convex) on the inside to fit into the anatomy between the back of the hand and the wrist. It lies flat against the back of the wrist and the forward part of it is bowed or contoured outwardly or backwardly allowing the hand to move into a position wherein the center of the ball can be aligned with the arm. The article can be made for the left hand as well. FIGS. 2, 3 and 4 illustrate how the contour of insert 36 enables and restrains wrist positioning so that the axis of the arm is aligned with the center of the ball. See line A — A in FIGS. 2, 3 and 4.

Numeral 56 designates another insert which has a bowed part 57, and a narrowed end part 58 which curves to the left as shown in FIG. 1. The bow in insert stiffener 56 is contoured to conform to the palm of the hand with the curved end 58 curving into the intermediate part of the palm toward the thumb.

The configuration of the positioner and its construction may be understood from FIGS. 1 through 4 showing it in position on the user's wrist and hand.

FIGS. 2, 3, and 4 illustrate the utilization of the positioner. As may be seen, the article is placed over the hand with the thumb and heel of the thumb extending through opening 50. Then, it is wrapped around the wrist and hand and secured by way of the VELCRO elements on the undersides of extensions 10 and 14 contacting VELCRO element 30. Strap 16 passes around the wrist, and the VELCRO element on its inner surface fastens to VELCRO element 28.

The position of the inserts can be observed from FIGS. 2, 3, and 4. The stiffener insert 56 is contoured to the inner surface of the hand and palm with the end 58 curving towards the thumb and being substantially at the center of the palm. Stiffener 36 is positioned at the back of the wrist and hand, and it is contoured to the anatomy at this area as described. Thus, the article when fitted on the hand and wrist is in a position as illustrated in FIGS. 2, 3, and 4. These figures illustrate the relative position of the hand and the article as respects a bowling ball 62. Ball 62 is a three-finger ball, having holes as shown.

From the foregoing description of the article, its utilization and purpose will be well understood. The device is identified as an automatic hand/wrist positioner for the following reasons. The inside stiffener member 56 serves the purpose of holding the wrist and hand in alignment with the center of the ball. More specifically, this stiffener extending into the palm of the hand from the inside of the wrist prevents the hand from flexing inwardly during that part of the swing when the arm is extended rearwardly. Stiffener piece 36 on the back of the hand and wrist prevents backward flexing of the wrist beyond the required position, and it gives firm support to the wrist as does the front stiffener member. During the act of delivering the bowling ball, at the time of release, when the thumb comes out of the thumb hole and the ball is supported on the fingers, the article as described helps the hand support the ball by preventing the wrist from flexing during this stage of the delivery cycle. The article as described has the capability of allowing the thumb to come out of the thumb hole of the bowling ball freely and in a more controlled release. The ultimate result is that the bowler has a more accurate and precise delivery with more revolutions on the ball. It has been demonstrated that use of the automatic hand/wrist positioner during bowling, it is possible to bowl more effectively which will result in a better score. It may be mentioned that the material of the article and the area of hole 50 is specially configurated as described so that the article in this area in position on the wrist and hand conforms to the contour of the anatomy.

From the foregoing, those skilled in the art will readily understand the nature of the invention, its construction, and the manner in which it realizes all of the objectives and advantages as set forth in the foregoing. The article is particularly adapted as a positioner for use by bowlers. However, the article may be used in other sports and activities where it is desired to provide control over wrist action. Accordingly, the invention is not limited to use by bowlers.

The foregoing disclosure is representative of a preferred form of the invention and is to be interpreted in an illustrative rather than a limiting sense, the invention to be accorded the full scope of the claims appended hereto.

What is claimed is:

1. A hand/wrist positioner for bowling comprising:

(a) a band of flexible material adapted to wrap about the hand and wrist of a bowler and having a first edge extending to the plam of the hand and across the back of the hand and a second edge extending about the wrist, said band including an aperture therethrouugh substantially adjacent said first edge for receiving the thumb of the bowler;

(b) a first pocket formed in said band and aligned on a first side of the aperture to extend over the back of the hand and the back of the wrist said first pocket opening along the second edge;

(c) a second pocket formed in said band and aligned on the opposite side of the aperture from said first pocket, said second pocket adapted to extend along the inside of the wrist and palm, said second pocket opening along the second edge;

(d) a first stiffener disposed within said first pocket, said first stiffener comprising first and second members being integral with each other and defining an oblique angle therebetween, said first and second members adapted to lie adjacent the back of the hand and wrist respectively and to maintain an angle between the back of the hand and wrist equal to said oblique angle;

(e) a second stiffener disposed within said second pocket, said second stiffener having a first substantially planar section adapted to lie adjacent the inside of the wrist, said first section depending into a narrowing second section, said second section being contoured downwardly from the plane of said first section and then depending upwardly to lie in the palm of the hand adjacent the thumb, said second section extending into an end portion which curves toward the thumb and towards the center of the palm; and (f) means for securing said band about the hand and wrist of the bowler.

* * * * *